United States Patent [19]

Fraser et al.

[11] 4,314,635

[45] Feb. 9, 1982

[54] CHECKING ACCOUNT CHECK AND CHECK BOOK ORDER-TAKING PORTFOLIO

[75] Inventors: Robert Fraser; John Rouse, both of Baltimore; Robert C. Redic; Suzanne Frock, both of Columbia, all of Md.

[73] Assignee: Falconer Security Printers, London, England

[21] Appl. No.: 182,757

[22] Filed: Aug. 29, 1980

[51] Int. Cl.[3] ..... B65D 73/00

[52] U.S. Cl. ..... 206/232; 150/52 B; 206/425

[58] Field of Search ..... 150/52 B; 206/232, 424, 206/425

[56] References Cited

U.S. PATENT DOCUMENTS 3,154,125 10/1964 Harvey ..... 150/52 B

*Primary Examiner*—Donald F. Norton

*Attorney, Agent, or Firm*—Cushman, Darby & Cushman

[57] ABSTRACT

A kit, primarily for use in marketing customer supplies, e.g. checks, check books, and check book covers, which is the form of a three panel per side portfolio, including a pocket for order forms, clear plastic coating on one face of the portfolio blank which folds and is second to provide six panel faces of protected graphics, and a single layer in the integral hinge regions for compact folding.

12 Claims, 10 Drawing Figures

CHECKING ACCOUNT CHECK AND CHECK BOOK ORDER-TAKING PORTFOLIO

BACKGROUND OF THE INVENTION

In the security and safety-paper printing and marketing industry, particularly for checking account customer supplies for banks and similar institutions, the availability at each bank branch information or new account deck of customer supplies order-taking book or kit of some type has come to be an essential marketing tool, both for the bank and for the supplier.

Traditionally, the books or kits have taken the form of a spiral-bound, ring-bound or loose-leaf book, with pages of suggestions, specimens and the like.

SUMMARY OF THE INVENTION

It is an object of the invention to provide a kit, primarily for use in marketing customer supplies, e.g. checks, check books, and check book covers, which is the form of a three panel per side portfolio, including a pocket for order forms, clear plastic coating on one face of the portfolio blank which folds and is secured to provide six panel faces of protected graphics, and a single layer in the integral hinge regions for compact folding.

The principles of the invention will be further discussed with reference to the drawings wherein a preferred embodiment is shown. The specifics illustrated in the drawings are intended to exemplify, rather than limit, aspects of the invention as defined in the claims.

DETAILED DESCRIPTION

Figure 9:
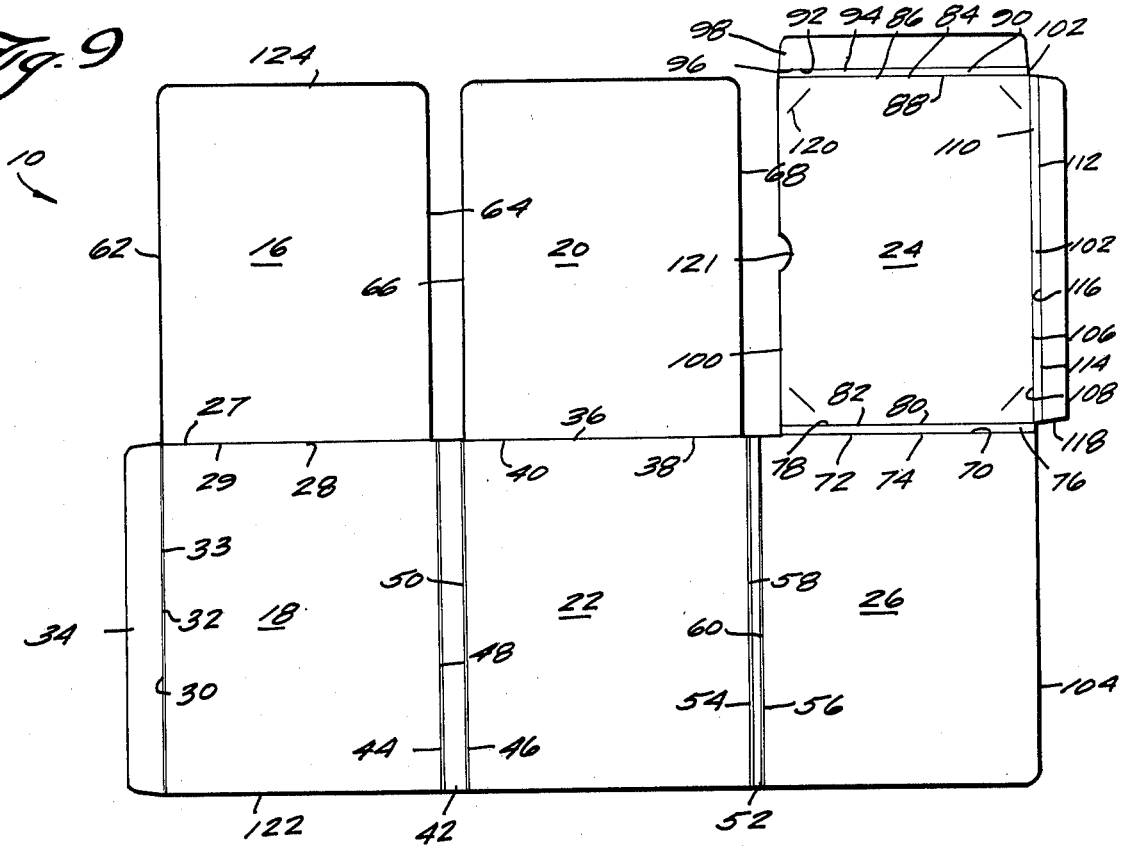
FIG. 9 is a smaller scale plan view of the non-glazed side of the blank from which the portfolio is assembled.

In FIG. 9 the blank 10 is shown having been die cut or similarly severed from a supply of preprinted paper board or similar file folder-weight stock, which is e.g. plastic coated on the printed side, in order to extend the life of the portfolio by reducing the potential that abrasion, or perspiration and the like due to handling will make the portfolio look less attractive or become shopworn and not have a desirable look of newness and freshness. The clear coating 12 applied over the printing

14 on the printed side, may be of exactly the prior art sort conventionally used on restaurant menus.

Figure 1:
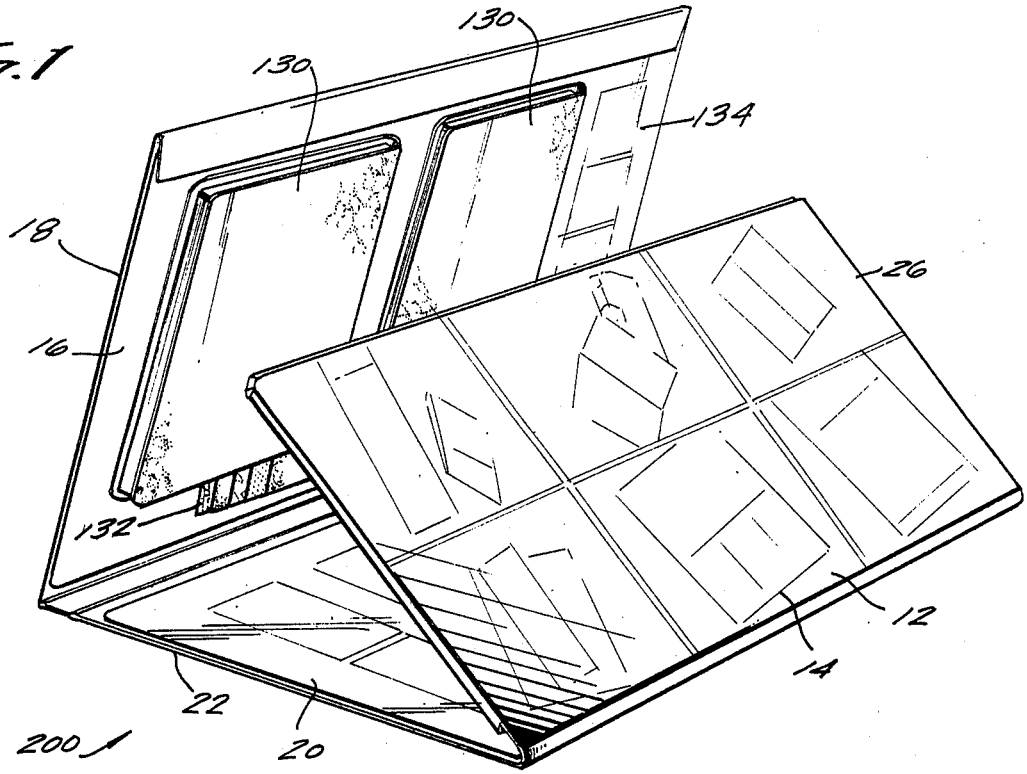
FIG. 1 is a perspective view of a checking account check and check book order-taking portfolio or similar article, in a partially opened condition.
Figure 2:
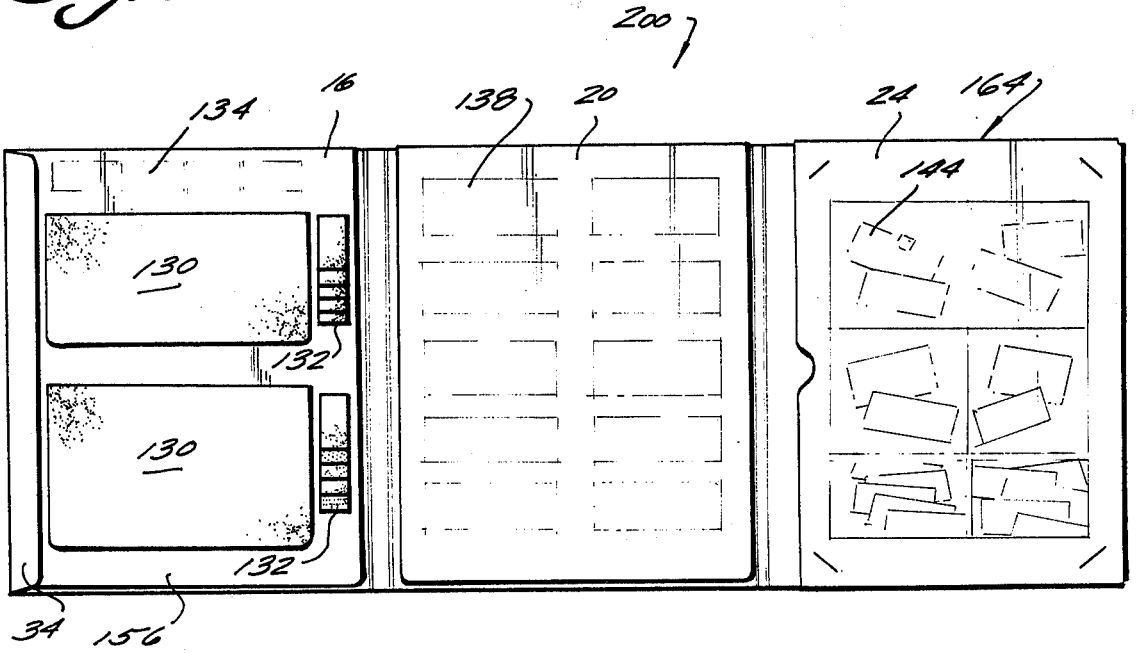
FIG. 2 is a top plan view thereof.
Figure 3:
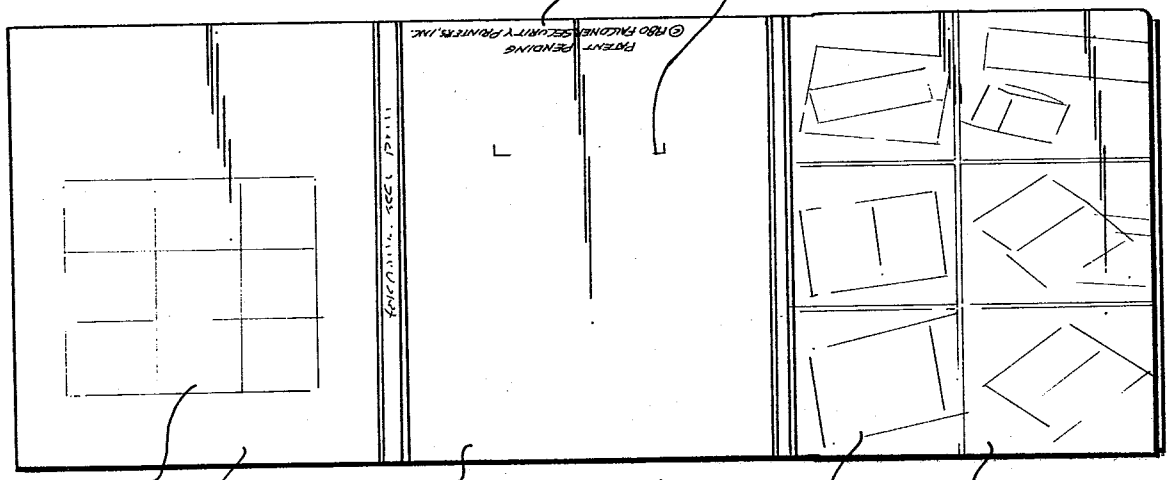
FIG. 3 is a bottom plan view thereof.
Figure 4:
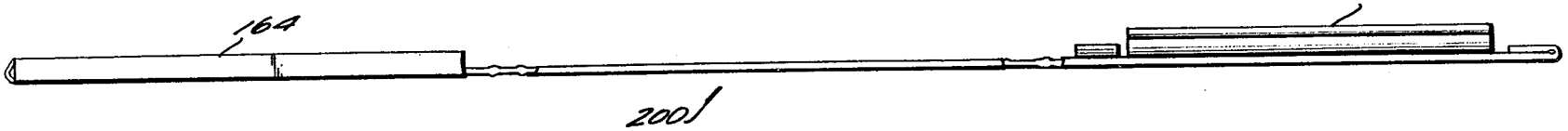
FIG. 4 is a rear elevational view thereof.
Figure 6:
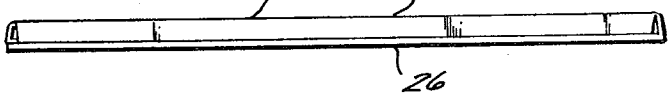
FIG. 6 is an outer end elevational view of the right panel thereof.
Figure 5:
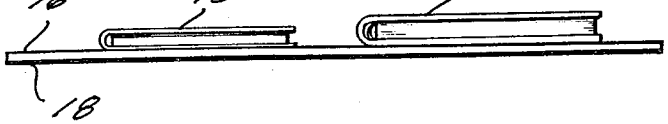
FIG. 5 is an outer end elevational view of the left panel thereof.

The blank 10 includes six rectangular major panels. In the text, these are referred to assuming the following orientation: that the user has the portfolio before him or her in a partially open condition, i.e. as depicted in FIG. 1, so that the "inside" or "front" is facing the user and the "outside" or "back" (shown in FIG. 4) is directed away from the user. Accordingly, the panels are designated herein: inside left 16, outside left 18, inside central 20, outside central 22, inside right 24 and outside right 26.

The upper edge 27 of the outside left panel 18 is integrally hinged on a respective horizontal fold line 28 to the upper edge 29 of the inside left panel 16.

The outer edge 30 of the outside left panel 18 is integrally hinged on a respective vertical fold line 32 to the basal edge 33 of a narrow (e.g. inch wide) flap 34.

The upper edge 36 of the outside central panel 22 is integrally hinged on a respective horizontal fold line 38 to the upper edge 40 of the inside central panel 20.

Between the outside left panel 18 and the outside central panel 22 there is provided a first narrow spine panel 42 integrally hinged on respective vertical fold lines 44 and 46 to the right edge 48 of the outside left panel 18 and the left edge 50 of the outside central panel 22.

Between the outside central panel 22 and the outside right panel 26 there is provided a second narrow spine panel 52 which typically is about half as broad as the first spine panel 42, and is integrally hinged on respective vertical fold lines 54 and 56 to the right edge 58 of the outside central panel 22 and the left edge 60 of the outside right panel.

The inside left panel 16 is slightly narrower than the outside left panel 18, so that neither of its vertical side edges 62, 64 interferes with folding on the fold lines 32, 44.

Likewise, the inside central panel 20 is slightly narrower than the outside central panel 22, so that neither of its vertical side edges 66, 68 interferes with folding on the fold lines 46, 54.

The inside left and central panels 16 and 20 respectively are no longer than and at least approximately as long as the respective outside left and outside central panels 18 and 22.

The upper edge 70 of the outside right panel 26 is integrally hinged on a respective horizontal fold line 72 to an outer edge 74 of an upper narrow boxing panel 76.

The upper edge 78 of the inside right panel 24 is integrally hinged on a respective horizontal fold line 80 to the inner edge 82 of the upper boxing panel 76.

The lower edge 84 of the inside right panel 24 is integrally hinged on a respective horizontal fold line 86 to the inner edge 88 of the lower boxing panel 90.

The outer edge 92 of the lower boxing panel 90 is integrally hinged on a respective horizontal fold line 94 to the basal edge 96 of a narrow flap 98.

The panels 76, 24, 90, 98 have a collective inner edge 100 that is stepped-back from the hinge line 56, and a collective outer edge 102 that is coincident with the outer edge 104 of the outside right panel 26.

The outer edge 102 of the inside right panel 24 is integrally hinged on a respective vertical fold line 106 to the inner edge 108 of a narrow outer boxing panel 110.

The outer edge 112 of the outer boxing panel 110 is integrally hinged along a vertical fold line 114 to the basal edge 116 of a narrow flap 118.

Four, short, oblique cuts or slots 120 arranged in a rectangular pattern are shown provided in the inside right panel 24, with a respective cut or slot generally forming an incomplete triangle with the respective panel edges at a respective corner of the panel 24. A thumb-access recess 121 is shown formed in the panel edge 100, about midway up the height thereof.

As will be understood in the paper blank art, some of the panels and flaps may be integrally joined along other edges than the ones shown, yet produce a functionally substantially identical product. For instance, the panels 18 and 16 could be joined along respective lower edges 122, 124 rather than along respective upper edges 26, 29.

In general, the boxing panels 76, 110 and 90 are equal in width and slightly narrower than the panel 52.

Although the informational layout of the six panels is subject to some variation without departing from the principles of the invention, a typical layout is tabulated as follows:

| Panel | Informational Content |
|---|---|
| 16 inside left panel | check book specimens 130; "shingles" of check book cover material specimens 132; and vignettes of other cover stock 134. |
| 18 outside left panel | cover art 136 (printed). |
| 20 outside central panel | specimen checks 138 (printed). |
| 22 outside central panel | patent and copyright notice 140; space 142 for over print by bank, regional supplier or contact-person at printers. |
| 24 inside right panel | check book cover styles and colors 144 (printed). |
| 26 outside right panel | check book types 146 (printed). |

Beside the graphics and/or specimens on each panel, there may be provided textual material giving information about the various possibilities and/or style numbers and similar information.

Figure 10:
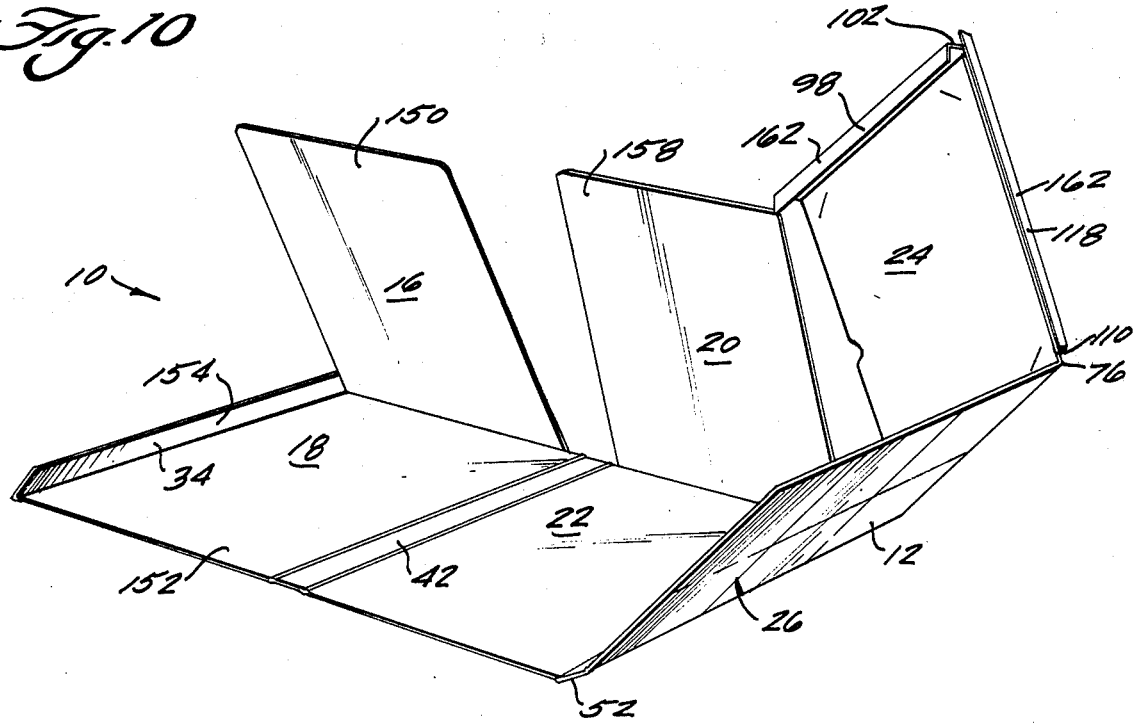
FIG. 10 is a perspective view of the blank from the non-glazed side, showing all the folds partly made.

After the folds being shown in the process of being made in FIG. 10 are completed, the various facially confronting surfaces are glued or otherwise adhered together using conventional adhesive materials and techniques. In particular, the unglazed face 150 of the inside left panel is adhered to the unglazed face 152 of the outside left panel, and then the unglazed face 154 of the flap 34 is adhered to the glazed face 156 of the inside left panel marginally of the outer edge of the inside left panel thus creating a composite left panel glazed on front and back, with a triple thickness marginally of the outer edge thereof. The unglazed face 158 of the inside central panel is adhered to the unglazed face of the outside central panel, thus creating a composite central panel glazed on the front and back. The glazed outer faces 160, 162 of the flaps 98 and 118 are adhered to the unglazed face of the outside right panel, respectively marginally of the lower and outer edges thereof, thus creating an inwardly open, interiorly unglazed, exteriorly glazed slip case 164, in which e.g. a stock of unused order blanks may be kept in loose or pad form. The cutout 121 allows easy pullout of slipcase contents. Of course other materials could be kept in the slip case, such as more specimens of check stock.

Figure 7:
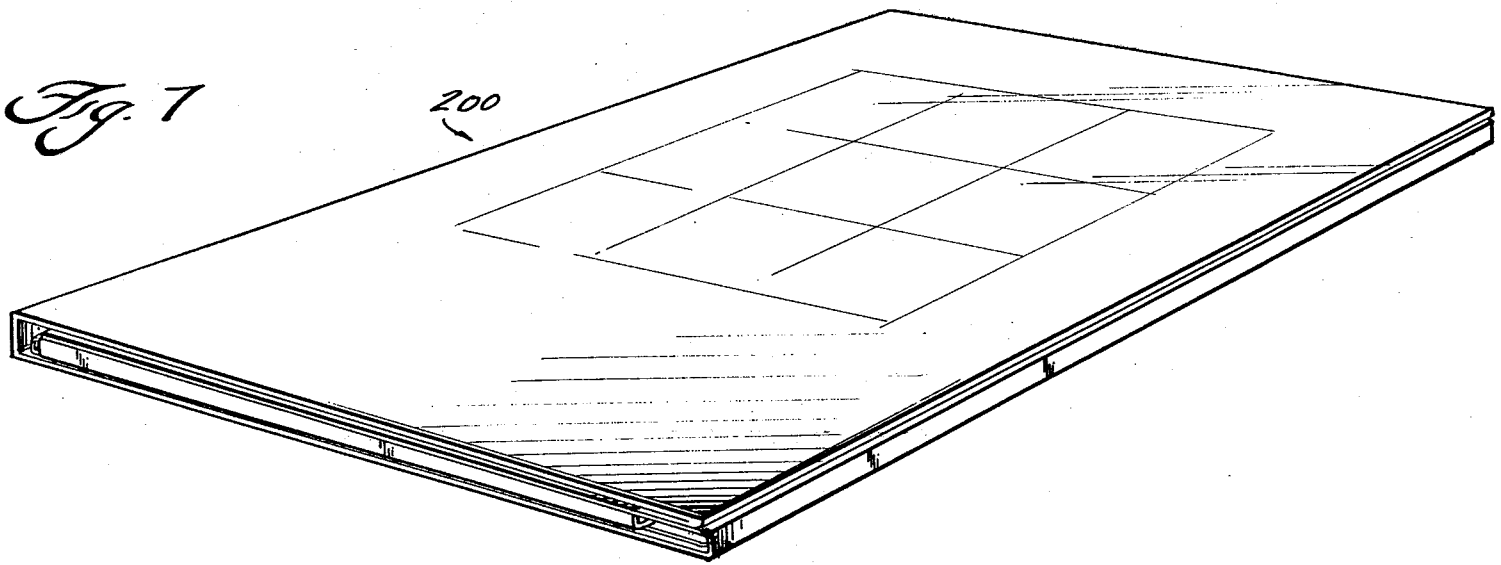
FIG. 7 is a perspective view of said portfolio or similar article in a folded-closed condition, looking obliquely toward the lower right corner of the left panel thereof.
Figure 8:
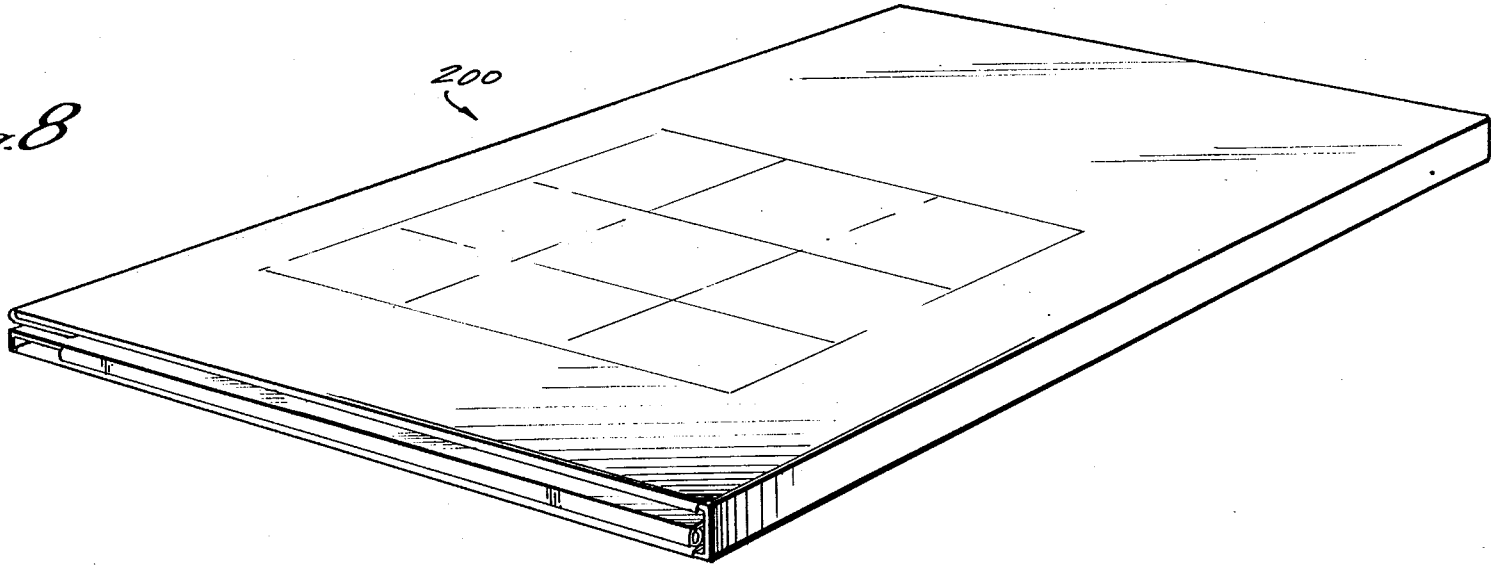
FIG. 8 is a perspective view thereof from a diagonally opposite vantage point, looking obliquely toward the upper left corner of the left panel thereof.

The sizes and thicknesses of the various materials, panels and flaps is such that when folded closed, as shown in FIGS. 7 and 8, the portfolio 200 of the invention is substantially rectangular prismatic in form.

The panels are preferably laid-out in such a way that when the portfolio is presented to a customer in a closed condition, the outside left panel 18 constitutes its front cover, inviting the customer to open by swinging the left panel about its hinges 44, 46. This act exposes two panel sides to the viewer: the inside left panel 16, with its check book specimens and check book cover samples, and the outside right panel 26 with its check book styles. The next natural act is for the customer to open out the right panel. This act exposes two more panel sides to the viewer: the inside central panel ith its array of check designs and the inside right panel with its array of check book cover selection possibilities. In addition, this act exposes the open mouth of the order pad slip case, so that the order pad may be withdrawn and an order blank filled in by or for the customer.

The order blank to be filled out may be temporarily superimposed on the inside right panel and its corners inserted through the cuts 120 so that the customer or bank employee may easily fill in the various choices of style, color and type and provide the other information requested on the form.

Of course, the specific title and the example given in detail herein may for certain contemplated uses of the invention not be fully informative. For instance, the portfolio may be used as a marketing tool at the wholesale level, or may be used as a display, without being used for taking orders at all. Further, it may be used in combination with other marketing efforts. To that end, the cuts 120 may be used for mounting a sheet to feature a new product or service the user-bank or that the user-printer wishes to being to the customer's or potential customer's attention as a tie-in with the portfolio presentation. Thus, the title and examples are truly exemplary but are not exclusive characterizations, as will be understood by those skilled in the art.

It should now be apparent that the checking account check and check book order-taking portfolio as described hereinabove, possesses each of the attributes set forth in the specification under the heading "Summary of the Invention" hereinbefore. Because it can be modified to some extent without departing from the principles thereof as they have been outlined and explained in this specification, the present invention should be understood as encompassing all such modifications as are within the spirit and scope of the following claims.

What is claimed is:

1. A checking account customer supplies-ordering portfolio, comprising:

a six rectangular panel blank of flexible sheet material having at least one face printed with indicia relating to checking account customer supplies, folded and zonally adhered to provide three composite panels integrally hinged together in a horizontally extending series comprising a central composite panel integrally hinged to a left-flanking composite panel and a right-flanking composite panel, with there being an integral hinge region comprising at least one respective vertical line fold between said central composite panel and each said flanking composite panel;

two of said composite panels, including said central composite panel and one of said flanking composite panels each comprising a respective two of said six rectangular panels of said blank folded over upon one another about a horizontal margin bend line common to both until back-to-back, with said printed face presented outwards; and adhesive means zonally applied between such two rectangular panels for adhering such two rectangular panels together; and the remaining one of said flanking composite panels comprising a respective two rectangular panels of said blank folded over upon one another about margin bend line means common to both and including two bend lines, each common to a respective margin of a respective said rectangular panel and both common to a first depth-providing boxing panel, and two tab means integral with a respective two different ones of the margins of either of said respective two rectangular panels of said remaining flanking composite panel; each such tab means comprising a tab having a basal margin, a depth-providing boxing panel, and two bend lines including one common to the respective rectangular panel and the respective boxing panel, and another common to the respective tab basal margin and the respective boxing panel; both of the tabs being represented face to face against the opposite one of the two rectangular panels of said remaining flanking composite panel than the one to which the respective tab means is integrally appended; and adhesive means zonally applied between and adhering said tabs to the respective said opposite one of the two rectangular panels;

the three boxing panels being of substantially equal depth, so that there is provided a one margin open rectangular slip case with said printed face of said blank providing the exterior of said slip case and the opposite side of said blank from said printed face providing the interior of said slip case.

2. The checking account customer supplies-ordering portfolio of claim 1, further comprising:

a layer of flexible, transparent plastic glazing upon said printed face of said blank.

3. The checking account customer supplies-ordering portfolio of claim 1, wherein:

each said integral hinge region between said central composite panel and a respective flanking composite panel comprises, in addition to a first said at least one respective vertical line fold a second said at least one respective vertical line fold with a rectangular, depth-providing boxing panel integrally extending between the first and second said at least one respective vertical line fold.

4. The checking account customer supplies-ordering portfolio of claim 3, wherein:

throughout each said integral hinge region said portfolio is constituted by but one thickness of said blank.

5. The checking account customer supplies-ordering portfolio of claim 4, wherein:

said boxing panel between said left-flanking composite panel and said central composite panel is approximately twice as deep as said boxing panel between said right-flanking panel and said central composite panel.

6. The checking account customer supplies-ordering portfolio of claim 5, further comprising:

at least one specimen check book secured to the inner said rectangular panel of said left-flanking composite panel, so that when said left-flanking composite panel is doubled over upon said right-flanking composite panel with said at least one specimen check book interposed between them, said portfolio is substantially in the shape of a right rectangular prism.

7. The checking account customer supplies-ordering portfolio of claim 3, wherein:

said slip case opens toward the respective adjoining said integral hinge region between the respective flanking composite panel and the central composite panel.

8. The checking account customer supplies-ordering portfolio of claim 7, wherein:

said slip case is provided on said right-flanking composite panel.

9. The checking account customer supplies-ordering portfolio of claim 1, wherein:

each said horizontal-margin bend line is at the top of said portfolio.

10. The checking account customer supplies-ordering portfolio of claim 1, wherein:

said two rectangular panels of said one flanking composite panel having an outer vertical margin one of which is integrally hinged along a fold line to a flap which is doubled over the other of said outer vertical margins; and an adhesive zonally applied between and adhering together said flap and said other outer vertical margin, to provide a triple thickness of said blank in the resulting region which includes said tab.

11. The checking account customer supplies-ordering portfolio of claim 10, wherein:

said flap is based on the outer one of said two rectangular panels of said one flanking composite panels.

12. The checking account customer supplies-ordering portfolio of claim 1, wherein:

each respective two rectangular panels folded over upon one another about a respective horizontal margin bend line comprises a narrower said rectangular panel having two free opposite vertical margins, and a broader said rectangular panel having one vertical margin thereof in common with a respective said integral hinge region, whereby said narrower rectangular panel fails to overlap said respective integral hinge region and said respective integral hinge region remains constituted by but one thickness of said blank.

* * * * *